US007306699B2

(12) United States Patent
Urlaub et al.

(10) Patent No.: US 7,306,699 B2
(45) Date of Patent: Dec. 11, 2007

(54) TISSUE PRODUCT CONTAINING A TOPICAL COMPOSITION IN THE FORM OF DISCRETE DROPLETS

(75) Inventors: John J. Urlaub, Oshkosh, WI (US); Thomas G. Shannon, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 378 days.

(21) Appl. No.: 10/730,872

(22) Filed: Dec. 9, 2003

(65) Prior Publication Data

US 2004/0163784 A1 Aug. 26, 2004

Related U.S. Application Data

(63) Continuation-in-part of application No. 10/335,138, filed on Dec. 31, 2002, now Pat. No. 7,008,507.

(51) Int. Cl.
*D21H 23/50* (2006.01)

(52) U.S. Cl. ..... 162/134; 162/135; 162/158; 162/109; 162/184; 428/195.1; 424/402

(58) Field of Classification Search ..... 162/109, 162/111–113, 135–137, 183–185, 123, 158; 428/195.1, 156, 211; 424/402; 427/361, 427/391

See application file for complete search history.

(56) References Cited

U.S. PATENT DOCUMENTS

| | | | | |
|---|---|---|---|---|
| 3,484,275 | A * | 12/1969 | Lewicki, Jr. | 427/10 |
| 3,556,932 | A | 1/1971 | Coscia et al. | |
| 3,556,933 | A | 1/1971 | Williams et al. | |
| 3,700,623 | A | 10/1972 | Keim | |
| 3,772,076 | A | 11/1973 | Keim | |
| 3,855,158 | A | 12/1974 | Petrovich | |
| 3,899,388 | A | 8/1975 | Petrovich et al. | |
| 4,129,528 | A | 12/1978 | Petrovich et al. | |
| 4,147,586 | A | 4/1979 | Petrovich et al. | |
| 4,222,921 | A | 9/1980 | Van Eenam | |
| 4,504,357 | A | 3/1985 | Holbein et al. | |
| D303,899 | S | 10/1989 | Ancona et al. | |
| D303,900 | S | 10/1989 | Ancona et al. | |
| 5,048,589 | A | 9/1991 | Cook et al. | |
| D327,820 | S | 7/1992 | Ancona et al. | |
| 5,129,988 | A | 7/1992 | Farrington, Jr. | |
| D334,510 | S | 4/1993 | Ancona et al. | |
| D334,873 | S | 4/1993 | Ancona et al. | |
| 5,399,412 | A | 3/1995 | Sudall et al. | |
| 5,405,678 | A | 4/1995 | Bilodeau | |
| 5,494,554 | A | 2/1996 | Edwards et al. | |
| 5,740,913 | A | 4/1998 | McFarland | |
| D401,483 | S | 11/1998 | Porcelli | |
| 5,851,651 | A | 12/1998 | Chao | |
| D408,694 | S | 4/1999 | Tisdale | |
| 5,935,381 | A | 8/1999 | Trokhan et al. | |
| 5,968,633 | A | 10/1999 | Hamilton et al. | |
| 6,027,611 | A | 2/2000 | McFarland et al. | |
| 6,040,014 | A | 3/2000 | Izmirlian et al. | |
| 6,096,412 | A | 8/2000 | McFarland et al. | |
| 6,099,940 | A | 8/2000 | Hamilton et al. | |
| 6,126,784 | A | 10/2000 | Ficke et al. | |
| 6,224,714 | B1 | 5/2001 | Schroeder et al. | |
| 6,238,519 | B1 | 5/2001 | Jones et al. | |
| 6,274,667 | B1 | 8/2001 | Shannon et al. | |
| 6,287,418 | B1 | 9/2001 | Schroeder et al. | |
| 6,365,667 | B1 | 4/2002 | Shannon et al. | |
| 6,416,624 | B1 | 7/2002 | Nielsen et al. | |
| 6,450,633 | B1 | 9/2002 | Kronzer | |
| 6,458,243 | B1 | 10/2002 | Jones et al. | |
| 6,475,601 | B1 * | 11/2002 | Sakaki et al. | 428/32.21 |
| 6,547,928 | B2 | 4/2003 | Barnholtz et al. | |
| 6,551,455 | B2 | 4/2003 | Johnson et al. | |
| 6,630,055 | B1 | 10/2003 | Goguelin et al. | |
| 6,705,717 | B1 * | 3/2004 | Fujita et al. | 347/106 |
| 6,733,773 | B1 | 5/2004 | Hsu et al. | |
| 7,008,507 | B2 * | 3/2006 | Urlaub et al. | 162/134 |
| 2002/0146548 | A1 | 10/2002 | Forry et al. | |
| 2003/0118847 | A1 * | 6/2003 | Chuang et al. | 428/447 |
| 2004/0082668 | A1 | 4/2004 | Vinson | |
| 2004/0099388 | A1 | 5/2004 | Chen et al. | |
| 2004/0118531 | A1 | 6/2004 | Shannon et al. | |
| 2004/0131842 | A1 * | 7/2004 | Urlaub et al. | 428/327 |
| 2004/0163784 | A1 * | 8/2004 | Urlaub et al. | 162/135 |
| 2005/0058833 | A1 | 3/2005 | Krzysik et al. | |

FOREIGN PATENT DOCUMENTS

| | | | |
|---|---|---|---|
| EP | 0213240 | A1 | 3/1987 |

(Continued)

OTHER PUBLICATIONS

PCT Search Report for PCT/US03/41259, Jun. 17, 2004.

(Continued)

*Primary Examiner*—José A. Fortuna
(74) *Attorney, Agent, or Firm*—Dority & Manning, P.A.

(57) ABSTRACT

A method for application of compositions onto non-woven webs, such as paper webs, and to products made from the process. In general, the method includes applying a composition to a non-woven web using a non-impact printer, such as an ink jet printer. The composition is applied, in one embodiment, as droplets that remain as discrete shapes on the substrate. In this manner, treated areas and untreated areas are formed on the web. Through this process, the water absorption and control properties of the web can be adjusted as desired while simultaneously treating the web with a composition that improves the physical properties of the web, improves the chemical properties of the web and/or can provide a benefit to a user if transferred from the web.

36 Claims, 7 Drawing Sheets

FOREIGN PATENT DOCUMENTS

| | | | |
|---|---|---|---|
| EP | 1034928 | A2 | 9/2000 |
| EP | 1034928 | A3 | 9/2000 |
| EP | 1245396 | A2 | 10/2002 |
| EP | 1245396 | A3 | 10/2002 |
| WO | WO 0040505 | A1 | 7/2000 |

OTHER PUBLICATIONS

U.S. Appl. No. 29/201,229, Burnett et al.

* cited by examiner

TISSUE PRODUCT CONTAINING A TOPICAL COMPOSITION IN THE FORM OF DISCRETE DROPLETS

RELATED APPLICATIONS

The present application is a Continuation-In-Part application of U.S. patent application Ser. No. 10/335,138 filed on Dec. 31, 2002 now U.S. Pat. No. 7,008,507.

BACKGROUND OF THE INVENTION

Consumers use paper wiping products, such as facial tissues, paper towels, and bath tissues, for a wide variety of applications. Facial tissues are not only used for nose care but, in addition to other uses, can also be used as a general wiping product. Consequently, there are many different types of tissue products currently commercially available.

In some applications, tissue products are treated with polysiloxane compositions in order to increase the softness of the product. Adding silicone compositions to a tissue can impart improved softness to the tissue while maintaining the tissue's strength.

In the papermaking industry, various manufacturing techniques have been specifically designed to produce paper products which consumers find appealing. Manufacturers have employed various methods to apply chemical additives, such as silicone compositions, to the surface of a tissue web. Currently, one method of applying chemicals to the surface of a tissue web is the Rotogravure printing process. A Rotogravure printing process utilizes printing rollers to transfer chemicals onto a transfer roll and then onto a substrate. Chemical emulsions that are applied to webs using the Rotogravure printing process typically require the addition of water, surfactants, and/or solvents in order for the emulsions to be printed onto the substrate. Such additions are not only costly but also increase drying time and add process complexity.

Another method of applying chemical additives to the surface of a tissue web is spray atomization. Spray atomization is the process of combining a chemical with a pressurized gas to form small droplets that are directed onto a substrate, such as paper. One problem posed with atomization processes is that manufacturers often find it difficult to control the amount of chemical and the placement or pattern of the chemical that is applied to a tissue ply. Thus, a frequent problem with spray atomization techniques is that a large amount of over-spray is generated, which undesirably builds upon machinery as well as the surfaces of equipment and products in the vicinity of the spray atomizer. Furthermore, over-spray wastes the chemical being applied, and comprises a generally inefficient method of applying additives to a tissue web. Additionally, lack of control over the spray atomization technique also affects the uniformity of application to the tissue web.

In view of the above, a need exists in the industry for improving the method for application of chemical additives to the surface of a paper web. While softening agents are exceptionally good at improving softness there are drawbacks to their use. Polysiloxanes are generally hydrophobic, that is, they tend to repel water. Tissue products treated with polysiloxane tend to be less absorbent than tissue products not containing polysiloxane. Hydrophilic polysiloxanes are known in the art, however, such hydrophilic polysiloxanes are more water soluble and hence when applied to a tissue sheet will tend to migrate more in the z-direction of the sheet than the hydrophobic polysiloxanes. This means that less polysiloxane is available on the surface of the tissue product at a given addition level. Hence, higher levels of hydrophilic polysiloxanes are required to achieve the same level of softness as hydrophobic polysiloxanes. Hydrophilic polysiloxanes are also usually sold at a cost premium to the hydrophobic polysiloxanes. Therefore, hydrophilic polysiloxanes tend to be less effective at softening and more costly to use than hydrophobic polysiloxanes.

Increased hydrophobicity in a paper product, such as a tissue, can adversely impact upon the ability of the wiping product to absorb liquids. Hydrophobic agents can also prevent bath tissue from being wetted in a sufficient amount of time and prevent disintegration and dispersing when disposed in a commode or toilet.

On the other hand, increasing the hydrophobicity of a paper web does provide various advantages. For example, by making the web hydrophobic, the fluid strike-through properties of the tissue product are improved. In other words, fluids absorbed by the web remain on the interior of the web and thus do not transfer to the hands of a user. Hydrophobic tissue products prepared using standard cellulose sizing agents are described in U.S. Pat. No. 6,027,611 issued to McFarland, et.al., and incorporated by reference herein. However, those skilled in the art will recognize the difficulties associated with using sizing agents to control hydrophobicity to a level acceptable for tissue products, the addition often resulting in products having unacceptably high levels of hydrophobicity. Furthermore, addition of sizing agents as described by McFarland, et.al., does not allow for regions of high and low hydrophobicity in the sheet but rather creates a uniformly hydrophobic sheet.

Hence, additives that are hydrophobic in nature can make it difficult to find a proper balance between improving the properties of a web through the use of the additive and yet maintaining acceptable absorbency and wetability characteristics.

It is known to add a wetting agent directly to a polysiloxane emulsion then topically apply the polysiloxane, wetting agent composition to the tissue sheet to mitigate the hydrophobicity caused by addition of the polysiloxane. While this perhaps reduces the overall hydrophobicity of the sheet it does not allow for making tissues having uniform polysiloxane coverage with alternating hydrophobic and hydrophilic regions.

It is also known to topically apply hydrophobic additives in discrete locations on a tissue sheet in conjunction with relatively large untreated areas of the sheet such that less than 50% of the surface of the sheet is covered with the additive. Such discrete placement of the additive on the tissue sheet is expected to provide regions of hydrophobicity and hydrophilicity. However, such discrete placement requires a majority of the tissue surface to not contain the additive. As a result, reduced product benefits, such as softness, are realized relative to a sheet having a high level of surface coverage. Furthermore, this process precludes use of hydrophobic additives prior to the tissue drying step.

U.S. Pat. Nos. 6,238,519 and 6,458,243 issued to Jones, et. al, describe the use of deactivated ketene dimer agents to reduce the hydrophobicity of sheets relative to those made with standard alkyl ketene dimers. While lower hydrophobicity is noted, the application precludes formation of specific regions of hydrophobicity and hydrophilicity, hence, the application of deactivated ketene dimers does not allow for fine tuning control of hydrophobic and hydrophilic properties.

Thus, a need also currently exists for tissue products and methods to prepare tissue products containing hydrophobic additives wherein the hydrophobic additive is present across a majority of the sheet surface, yet the benefits to the product are provided without increasing the hydrophobicity of the product beyond desirable limits.

SUMMARY OF THE INVENTION

In general, the present invention is directed to an improved process for applying compositions to paper webs, such as tissue webs. The present invention is also directed to improved paper products made from the process.

For example, in one embodiment, the present invention is directed to a process for applying an additive to a paper web, such as a tissue web, that includes the steps of providing a non-woven sheet and non-impact printing a composition onto at least one side of the sheet. The composition can be applied using, for instance, an ink jet printer. The ink jet printer can be, for example, a piezoelectric printer, a valve jet printer, or a thermal printer. The composition is deposited on the sheet in the form of discrete droplets. The droplets can have a diameter of less than about 4 mm. The composition can be applied to the sheet in a discontinuous manner such that the sheet includes treated areas where the droplets reside and untreated areas. The treated areas can comprise from about 5% to about 90% of the surface area of at least one side of the sheet.

The composition can generally be any material that provides benefits to tissue webs. For instance, the composition can be a topical preparation that improves the physical properties of the web, that provides the web with antibacterial properties, that provides the web with medicinal properties, or that provides any other type of wellness benefits to a user of the paper web. For instance, the composition can contain an anti-acne agent, an anti-microbial agent, an anti-fungal agent, an antiseptic, an antioxidant, a cosmetic astringent, a drug astringent, a biological agent, an emollient, an external analgesic, a humectant, a moisturizing agent, a skin conditioning agent, a skin exfoliating agent, a sunscreen agent, and mixtures thereof. In one embodiment, the composition is a softener. The softener can be, for instance, a polysiloxane.

In other embodiments, the composition may contain agents that improve the strength of the web. For instance, the process of the present invention can be used to apply wet and dry strength agents and temporary wet strength agents.

The amount of the composition that is applied to the paper web depends on the particular application. For example, when applying a softener to a tissue web, the softener can be added in an amount from about 0.1% to about 10% by weight and particularly from about 0.1% to about 5% by weight, based upon the weight of the web.

The non-woven sheet treated in accordance with the present invention can be made from pulp and/or synthetic fibers by any method known in the art. In one embodiment, for instance, the non-woven sheet is a tissue sheet having a bulk of at least 2 $cm^3/g$. The paper web can be used to make, for instance, a facial tissue, a bath tissue or a paper towel. The non-woven sheet can be made from a single ply or can comprise multiple plies. When constructing a paper product, the non-woven sheet can generally have a basis weight, in one embodiment, of from about 10 gsm to about 80 gsm.

The droplets that are applied to the non-woven sheet using the non-impact printer can vary in size as desired. For example, in one embodiment, the droplets can have a diameter of less than about 200 microns, such as less than about 50 microns. The droplets can be applied to the sheet at a density of about at least 5 drops per inch in the machine direction. For instance, the density of the droplets can be from about 5 drops per inch to about 1,000 drops per inch.

The process of the present invention provides great control over the amount of composition applied to the web and the placement of the composition on the web. It is believed that products made according to the process of the present invention have various unique characteristics. For instance, in one embodiment, a product made according to the present invention includes a paper web containing cellulosic fibers. The viscous composition containing a chemical additive is applied to at least one side of the paper web.

In particular, the composition can be applied in the form of discrete droplets forming treated areas on a sheet separated by untreated areas. Due to the presence of the untreated areas, a hydrophobic composition can be applied to the sheet without completely destroying the ability of the sheet to absorb water. For example, even after being treated with a hydrophobic composition, a paper sheet made according to the present invention can have a Wet Out Time of less than about 10 seconds, such as less than about 6 seconds.

In one embodiment, the non-impact printer that applies the composition to the non-woven sheet is digitally controlled by a controller. In this embodiment, the composition can be applied to the sheet according to a pattern that has been programmed into the controller.

In one particular embodiment, the non-woven web being treated can include a pattern that has been incorporated into the structure of the web. For instance, the web can include densified areas. According to the present invention, the controller used to control the non-impact printer can be configured to apply a composition to the sheet in a pattern that matches the pattern of the densified areas.

Of particular advantage, applying a composition using a non-impact printer has been found to control migration of the composition. In particular, a composition, such as one containing a softening agent, can be applied to a tissue and primarily remain on the surface of the tissue without significant penetration in the Z direction. For instance, in one embodiment, a composition can be applied to a tissue sheet such that over 70% of the composition remains on the surface, over 75% remains on the surface, over 80% remains on the surface, over 85% remains on the surface, over 90% remains on the surface, and, in some embodiments, greater than 95% of the composition may remain on the surface. By not penetrating into the tissue sheet, the softening agent remains on the surface where the benefits of the composition are realized by the user.

Various features and aspects of the present invention will be made apparent from the following detailed description.

BRIEF DESCRIPTION OF THE DRAWINGS

A full and enabling disclosure of this invention, is set forth in this specification. The following Figures illustrate the invention.

Figure 1:
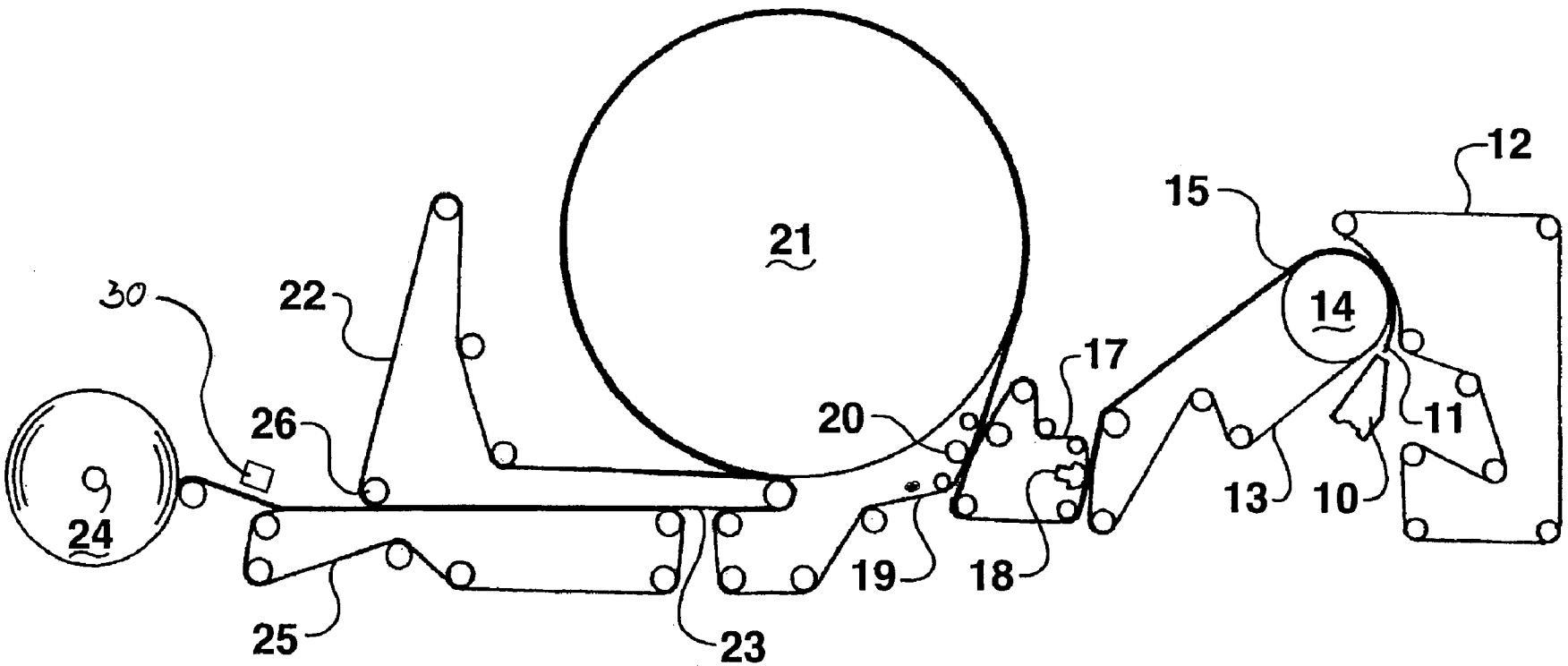
FIG. 1 is a schematic drawing of one embodiment of a process for producing paper webs in accordance with the present invention.

Repeated use of reference characters in the present specification and drawings is intended to represent the same or analogous features of the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in the invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to applying chemical compositions onto non-woven webs, such as tissue and other paper webs. In accordance with the present invention, the composition is applied to the paper web using a non-impact printer, such as an ink jet printer. As used herein, a non-impact printer refers to a printer that applies a composition to a surface with a print head in which the print head itself does not contact the surface. The compositions that are applied to the paper products in accordance with the present invention include compositions that contain chemical additives that improve the physical and/or chemical properties of the product. For example, the composition can contain an additive that improves the feel of a paper product or, alternatively, an additive that is designed to be transferred to an adjacent surface or to a user during use of the product.

When used in accordance with the present invention for applying compositions to non-woven webs, non-impact printers have been found to provide various advantages and benefits, especially in comparison to the devices that have been used in the past to apply similar compositions to paper webs. For example, in comparison rotogravure printing processes and spray atomization processes, the process of the present invention provides more flexibility with respect to operation parameters. Further, it has been found that the process of the present invention provides better controls over flow rates and add-on levels of the compositions being applied to the webs. The process of the present invention is also better suited to preventing over-application of the composition and can provide better controls over placement of the composition onto the web.

Further, the present inventors have discovered that the non-impact printing process of the present invention is particularly well-suited to applying hydrophobic compositions, to paper webs. Specifically, in the past, hydrophobic compositions, such as polysiloxanes and other additives, were used sparingly in some applications due to their hydrophobicity. For instance, problems have been experienced in applying hydrophobic additives to tissue products due to the adverse impact upon the wettability of the product.

According to the present invention, however, hydrophobic compositions can be applied to non-woven webs as small, discrete drops. The drops can have a substantially uniform drop size or can be non-uniform in size depending upon the particular circumstances. By applying the hydrophobic composition as discrete drops at particular areas on the web, it has been discovered that the compositions can be applied to the webs for improving the properties of the webs while maintaining acceptable wettability properties. As will be described in more detail below, in one embodiment of the present invention, for instance, a hydrophobic composition can be applied in a discrete or discontinuous manner to a paper web in order to maintain a proper balance between improving the properties of the web through the use of the composition and maintaining acceptable absorbency and wettability characteristics.

The process of the present invention also allows for the composition to be applied in distinct patterns. For instance, due to the accuracy of the process, the composition can be applied according to any suitable uniform or non-uniform pattern. For example, in one embodiment, the composition can be applied in columns, as discrete shapes, or even as a checkered pattern.

As described above, in one embodiment of the present invention, the non-impact printer used in the process of the present invention is an ink jet printer. Ink jet printers typically include an ink jet print head that has a plurality of orifices. A composition made according to the present invention may be expelled from one or more of these orifices thus exiting the print head of the ink jet printer. Drops of the composition then travel a throw distance between the print head and the non-woven web being treated. The orifices of the print head may be aligned in a single row or may be formed having various patterns. The composition may be expelled from these orifices either simultaneously or through selected orifices at any given time. For many applications, the throw distance from the print head to the surface onto which the composition is applied is typically less than about 15 mm, and is commonly less than about 5 mm. For high speed applications, for instance, the throw distance may be less than about 3 mm.

According to the present invention, any suitable ink jet printing device can be used for applying compositions to non-woven webs, such as tissue webs, spunbond webs, meltblown webs, bonded carded webs, and the like. Examples of ink jet printers that can be incorporated into the present invention, for instance, include thermal ink jet printers, piezoelectric printers, and valve jet printers.

Through the use of the above non-impact printers, a composition can be applied to a paper web in accordance with the present invention in a very controlled manner. Specifically, the non-impact printers of the present invention allow the composition to be applied to a non-woven web as discrete droplets. The size of the droplets can be varied as desired. Further, placement of the droplets on the non-woven web can be precisely controlled using a controller, such as a microprocessor or other type of programmable logic unit.

Once the droplets strike a substrate, the droplets may remain as discrete treated areas on the substrate. Whether the droplets remain as discrete shapes on the substrate is a function of substrate wetting and spread. Wetting and spread is a complex function reliant on many attributes such as the chemistry applied, the web speed, the ambient conditions, the web makeup, etc. Because the printers do not contact the non-woven web, however, the non-impact printers limit the spread of the composition once applied in the XY and Z directions and allow for the fine and discrete drops to remain intact on the sheet if desired.

Drop size and the pattern used to apply the composition can be varied to allow for optimal sensory properties on the sheet, such as softness, while still allowing for absorbency. Further, non-impact printers can also be adjusted in order to control the amount of surface penetration that occurs when the composition contacts the non-woven web. For example, in some applications, it is desired for the composition being applied to the non-woven web to remain on the surface and not migrate into the interior layers of the web.

In general, any flowable composition capable of being emitted by a non-impact printer can be applied to a non-woven web in accordance with the present invention. Possible ingredients or chemical additives that can be applied to non-woven webs include, without limitation, anti-acne actives, antimicrobial actives, antifungal actives, antiseptic actives, antioxidants, cosmetic astringents, drug astringents, biological additives, deodorants, emollients, external analgesics, film formers, fragrances, humectants, natural moisturizing agents and other skin moisturizing ingredients known in the art, opacifiers, skin conditioning agents, skin exfoliating agents, skin protectants, solvents, sunscreens, and surfactants. Other chemical additives include wet and dry strength agents that are either considered permanent strength agents or temporary strength agents. Debonders may also be applied in accordance with the present invention. The above chemical additives can be applied alone or in combination with other additives in accordance with the present invention.

In one embodiment of the present invention, the composition contains a hydrophobic chemical additive. As used herein, a hydrophobic chemical additive refers to a chemical additive that decreases the ability of a substrate to absorb water after the additive has been applied to the surface of the substrate. For example, the hydrophobic chemical additive can be a softener that is intended to be applied to a tissue product, such as a bath tissue, a facial tissue, or a paper towel. As described above, by applying a hydrophobic composition in a discontinuous manner through the use of a non-impact printer, a tissue product can be produced not only having a lotiony, soft feel, but also having good wettability even with the addition of the hydrophobic composition.

In one embodiment, the hydrophobic softener can be a polysiloxane. Suitable polysiloxanes that can be used in the present invention include amine, aldehyde, carboxylic acid, hydroxyl, alkoxyl, polyether, polyethylene oxide, and polypropylene oxide derivatized silicones, such as aminopolydialkylsiloxanes. When using an aminopolydialkysiloxane, the two alkyl radicals can be methyl groups, ethyl groups, and/or a straight branched or cyclic carbon chain containing from about 3 to about 8 carbon atoms. Some examples of polysiloxanes include AF-21, AF-23 and EXP-2025G of Kelmar Industries, Y-14128, Y-14344, Y-14461 and FTS-226 of the Witco Corporation, and Dow Corning 8620, Dow Corning 2-8182 and Dow Corning 2-8194 of the Dow Corning Corporation.

In one particular embodiment of the present invention, the composition can contain a softener having the following general chemical formula:

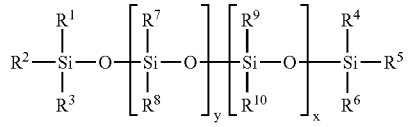

Wherein, x and y are integers such that at least one of x or y is >0. The mole ratio of x to (x+y) can be from about 0 percent to about 80 percent. The $R^1$-$R^{10}$ moieties can be independently any organofunctional group including $C_1$ or higher alkyl groups, ethers, polyethers, polyesters, amines, imines, amides, or other functional groups including the alkyl and alkyl analogues of such groups and including mixtures of said groups. A particularly useful moiety is a polyether functional group having the generic formula: $—R^{12}—(R^{13}—O)_a—(R^{14}O)_b—R^{15}$, wherein $R^{12}$, $R^{13}$, and $R^{14}$ are independently $C_{1-4}$ alkyl groups, linear or branched; $R^{15}$ can be H or a $C_{1-30}$ alkyl group; and, "a" and "b" are integers of from about 1 to about 100, more specifically from about 5 to about 30.

In one embodiment, the polysiloxane is an aminofunctional polysiloxane where the $R^{10}$ moiety includes a primary, secondary, tertiary or cationic amine group and the ratio of x to (x+y) is from about 0.005 percent to about 40 percent.

The temperature of the composition as it is applied to a paper web in accordance with the present invention can vary depending upon the particular application. For instance, in some applications, the composition can be applied at ambient temperatures. In other embodiments, however, the composition can be heated prior to or during application. The composition can be heated, for instance, in order to adjust the viscosity of the composition. The composition can be heated by a pre-heater prior to entering the printer or, alternatively, can be heated within the non-impact printer itself using, for instance, an electrical resistance heater.

In one embodiment, the composition containing the chemical additive can be a solid at ambient temperatures (from about 20° C. to about 23° C.). In this embodiment, the composition can be heated an amount sufficient to create a flowable liquid that can be emitted from a printing head. Once applied to a non-woven web, the composition can resolidify upon cooling.

Examples of additives that may need to be heated prior to being deposited on a paper web include compositions containing behenyl alcohol. Other compositions that may need to be heated include lotions, compositions that contain a wax, compositions that contain any type of polymer that is a solid at ambient temperatures, gelatinous materials, high rheology liquids, and/or compositions that contain a silicone.

In one exemplary embodiment of the present invention, the composition is a lotion. The lotion can be water-based or oil-based. Suitable water-based compositions include, but are not limited to, emulsions and water-dispersible compositions which can contain, for example, debonders (cationic, anionic or nonionic surfactants), or polyhydroxy compounds such as glycerin or propylene glycol.

Oil-based lotions can contain, for instance, a mixture of an oil and a wax. For example, the composition can contain from about 30% to about 90% by weight oil and from about 10% to about 40% by weight wax. In some embodiments, a fatty alcohol can also be included in an amount from about 5% to about 40% by weight.

Suitable oils include, but are not limited to, the following classes of oils: petroleum or mineral oils, such as mineral oil and petrolatum; animal oils, such as mink oil and lanolin oil; plant oils, such as aloe extract, sunflower oil and avocado oil; and silicone oils, silicone fluids, silicone emulsions or mixtures thereof. For example, dimethicone and alkyl methyl silicones can be used.

Suitable waxes include, but are not limited to, the following classes: natural waxes, such as beeswax and carnauba wax; petroleum waxes, such as paraffin and ceresin wax; silicone waxes, such as alkyl methyl siloxanes; or synthetic waxes, such as synthetic beeswax and synthetic sperm wax or mixtures thereof.

Suitable fatty alcohols include alcohols having a carbon chain length of from about 14 to about 30 carbon atoms, including acetyl alcohol, stearyl alcohol, behenyl alcohol, and dodecyl alcohol.

One particular embodiment of an oil-based lotion that may be applied in accordance with the present invention is the following:

| INGREDIENT | WEIGHT PERCENT |
|---|---|
| Mineral Oil | 25 |
| Acetylated Lanolin Alcohol (ACETULAN available from Amerchol) | 10 |
| Tridecyl Neopentoate | 10 |
| Cerasin Wax | 25 |
| DOW Corning 200 20 cSt | 30 |

The above compositions can be heated to a temperature, for instance, from about 75° C. to about 150° C. during application. In some embodiments, the compositions rapidly solidify after deposition. Consequently, these compositions have less tendency to penetrate and migrate into the sheet being treated. Thus, a greater percentage of the lotion is left on the surface of the web where it can contact and/or transfer to the user's skin to provide a benefit minimizing contamination of the center of the tissue.

The viscosity of the composition being applied to the non-woven web in accordance with the present invention will depend upon the particular non-impact printer being used and the desired results. For example, viscosity can be used to control migration of the composition. For many applications, when being applied to a non-woven web, the viscosity of the composition should be less than about 100 cp, such as less than about 50 cp. For example, in one embodiment, the viscosity can be less than about 25 cp when the composition is emitted from the non-impact printer. In particular embodiments, for instance, the viscosity of the composition may be less than about 60 cp when using a valve jet printer. When using a piezoelectric printer, on the other hand, the composition can have a viscosity of less than about 5 cp.

The process of the present invention can be used to apply compositions and chemical additives to numerous and various different types of products. For example, in one embodiment, the present invention is directed to applying chemical additives to paper products, particularly tissue products. Such products can include bath tissues, facial tissues, paper towels, industrial wipers, and the like. The paper product can be a single ply product or, alternatively, a multi-ply product. For example, in one embodiment, the paper product is a three-ply facial tissue. The paper product can have a basis weight of from about, for instance, about 10 gsm to about 120 gsm. In general, bath tissues and facial tissues have a basis weight of less than about 50 gsm, while paper towels and industrial wipers typically have a basis weight of greater than about 30 gsm. When treating tissue products, in general, the tissue may have a bulk of greater than about 2 cc/g.

In addition to paper products, it is believed that various other non-woven webs can also be treated in accordance with the present invention. For example, polymeric non-woven webs, such as spunbond webs and meltblown webs can also be treated. Other non-woven webs include hydroknit webs, and coformed webs. Hydroknit and coformed webs can include a combination of both synthetic fibers and pulp fibers.

When treating a tissue web in accordance with the present invention, the tissue web can be made from any suitable paper making process and can contain various types of paper making fibers. Such fibers can include, for instance, any natural or synthetic cellulosic fibers including, but not limited, non-woody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood Kraft fibers; hardwood fibers, such as eucalyptus, maple, birch and aspen fibers. Woody fibers can be prepared in high-yield or low-yield forms and can be pulped in any known method. High-yield pulp fibers are those paper making fibers produced by pulping processes providing a yield of about 65% or greater, more specifically about 75% or greater and still more specifically about 75% to about 95%. Yield is the resulting amount of processed fibers expressed as a percentage of the initial wood mass. Such pulps include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high-yield sulfite pulps, and high-yield Kraft pulps, all of which leave the resulting fibers with high levels of lignin.

The cellulosic fibers can also include paper broke or recycled fibers, mercerized fibers, regenerated cellulosic fibers, and the like.

A portion of the fiber furnish, such as up to about 50% or less by dry weight, such as from about 5% to about 30% by dry weight, can be synthetic fibers such as rayon fibers, polyolefin fibers, polyester fibers, bicomponent sheath-core fibers, multi-component binder fibers, and the like. Synthetic cellulose fibers include rayon fibers and other fibers derived from viscose or chemically modified cellulose.

In addition to various types of different fibers, paper webs made according to the present invention can also contain various fillers. Examples of fillers include clays, minerals, particulates, optical brighteners, and organic fillers.

Tissue webs made in accordance with the present invention can be made with a homogeneous fiber furnish or can be formed from a stratified fiber furnish producing layers within a single ply. Stratified base webs can be formed using equipment known in the art, such as a multi-layered headbox. Both strength and softness of the base web can be adjusted as desired through layered tissues, such as those produced from stratified headboxes. Strength and softness of the web can also be adjusted when using a homogenous fiber furnish by changing the blend of fibers used.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present invention includes a first outer layer and a second outer layer containing primarily hardwood fibers, such as eucalyptus fibers. The hardwood fibers can be mixed, if desired, with paper broke in an amount up to about 10% by weight and/or softwood fibers in an amount up to about 10% by weight. The base web further includes a middle layer positioned in between the first outer layer and the second outer layer. The middle layer can contain primarily softwood fibers. If desired other fibers, such as high-yield fibers or synthetic fibers may be mixed with the softwood fibers in an amount up to about 10% by weight.

When constructing a web from a stratified fiber furnish, the relative weight of each layer can vary depending upon the particular application. For example, in one embodiment, when constructing a web containing three layers, each layer can be from about 15% to about 40% of the total weight of the web, such as from about 25% to about 35% of the weight of the web.

As described above, the tissue product of the present invention can generally be formed by any of a variety of papermaking processes known in the art. In fact, any process capable of forming a paper web can be utilized in the present invention. For example, a papermaking process of the present invention can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. No. 5,048,589 to Cook, et al.; U.S. Pat. No. 5,399,412 to Sudall et al.; U.S. Pat. No. 5,129,988 to Farrinqton, Jr.; U.S. Pat. No. 5,494,554 to Edwards et al.; which are incorporated herein in their entirety by reference thereto for all purposes. For most applications, paper webs made according to the present invention will have a bulk of about 2 $cm^3/g$ or greater.

For example, the web can contain pulp fibers and can be formed in a wet-lay process according to conventional paper making techniques. In a wet-lay process, the fiber furnish is combined with water to form an aqueous suspension. The aqueous suspension is spread onto a wire or felt, dewatered, and dried to form the web.

In one embodiment, the base web is formed by an uncreped through-air drying process. Referring to FIG. 1, a schematic process flow diagram illustrating a method of making uncreped throughdried sheets in accordance with this embodiment is illustrated. Shown is a twin wire former having a papermaking headbox 10 which injects or deposits a stream 11 of an aqueous suspension of papermaking fibers onto the forming fabric 13 which serves to support and carry a newly-formed wet web 15 downstream in the process as the web is partially dewatered to a consistency of about 10 dry weight percent. Specifically, the suspension of fibers are deposited on the forming fabric 13 between a forming roll 14 and another dewatering fabric 12. Additional dewatering of the wet web 15 can be carried out, such as by vacuum suction, while the wet web is supported by the forming fabric.

The wet web 15 is then transferred from the forming fabric to a transfer fabric 17 traveling at a slower speed than the forming fabric in order to impart increased stretch into the web. Transfer is preferably carried out with the assistance of a vacuum shoe 18 and a fixed gap or space between the forming fabric and the transfer fabric or a kiss transfer to avoid compression of the wet web.

The web is then transferred from the transfer fabric to the throughdrying fabric 19 with the aid of a vacuum transfer roll 20 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer is preferably carried out with vacuum assistance to ensure deformation of the sheet to conform to the throughdrying fabric, thus yielding desired bulk and appearance.

The level of vacuum used for the web transfers can be, for instance, from about 3 to about 15 inches of mercury (about 75 to about 380 millimeters of mercury), such as about 5 inches (about 125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of about 94 percent or greater by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern.

In accordance with one embodiment of the present invention, prior to being wound on the reel 24, the paper web 23 is treated with a composition that is emitted by a non-impact printer 30 such as an ink jet printer. As shown in FIG. 1, the non-impact printer 30 is positioned adjacent to the reel 24.

In addition to the embodiment shown in FIG. 1, the method of the present invention may be used to apply chemicals to the web at any point after web formation. This includes application on the tissue machine such as after the initial dewatering section where the web has a consistency of from about 10 to about 50 percent, in the drying section where the web may have a consistency of from about 15 to about 100%, after the drying section between the drying section and the reel where the web may have a consistency of from about 80 to 100%, between the reel and rewinder where the web may have a consistency of from about 80 to 100%. The method may also be used to apply chemicals to the formed web in an offline process separate from the tissue making machine.

Figure 2:
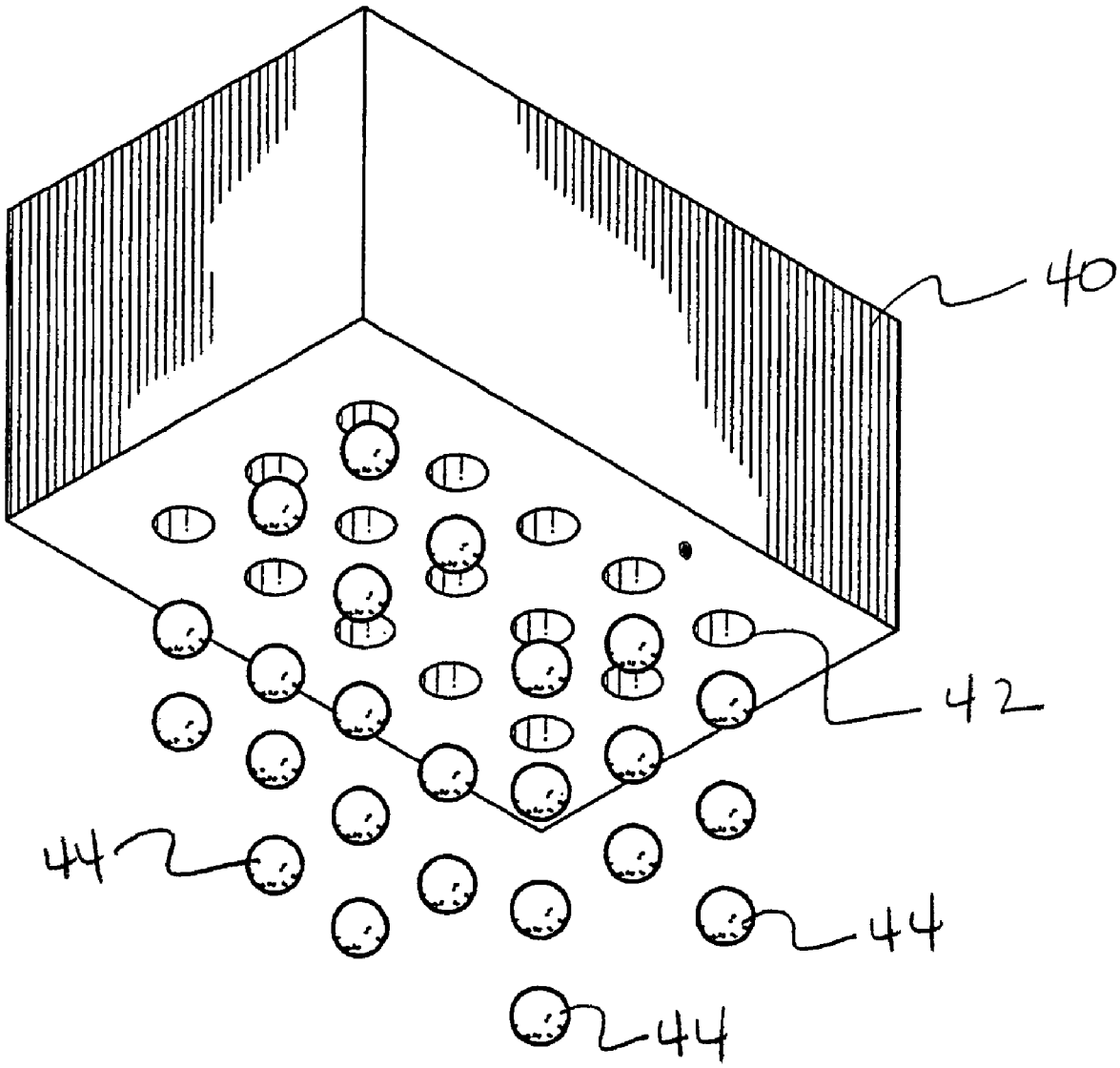
FIG. 2 is a perspective view of one embodiment of an ink jet printing head for use in the process of the present invention.

In one embodiment, the non-impact printer 30 will include a print head that traverses across the web and applies a composition according to the present invention. The composition is applied to the web in the form of small discrete droplets. For example, one embodiment of a print head 40 is shown in FIG. 2. As illustrated, a series of orifices 42 are present on the surface of the print head 40. As used in the art, the orifices 42 are sometimes referred in ink jet technology as being "jets". A composition 44 that affects the functional properties of a web being treated is dispensed through the orifices 42 of the print head 40. The composition 44 is shown in FIG. 2 as being dispensed through several but not all of the orifices 42. It should be understood, however, in other exemplary embodiments of the present invention, the composition 44 may be dispensed through any number or all of the orifices 42. In addition, the composition 44 may be dispensed in unequal amounts through different orifices 42.

The composition 44 is shown as being in the form of a series of drops. In other embodiments, the print head 40 or the composition can be modified such that the composition is dispensed as a steady stream or a configuration of drops which take various shapes.

When in the form of drops, the volume of the drops can vary depending upon the physical properties of the composition and the particular non-impact printer that is used. For example, when using a thermal ink jet printer or a piezoelectric ink jet printer, the drops can have a volume of from about 5 picoliters to about 500 picoliters and particularly from about 30 picoliters to about 200 picoliters. When using other printing devices, such as a valve jet printer, however, the size of the droplets can significantly increase.

Figure 4:
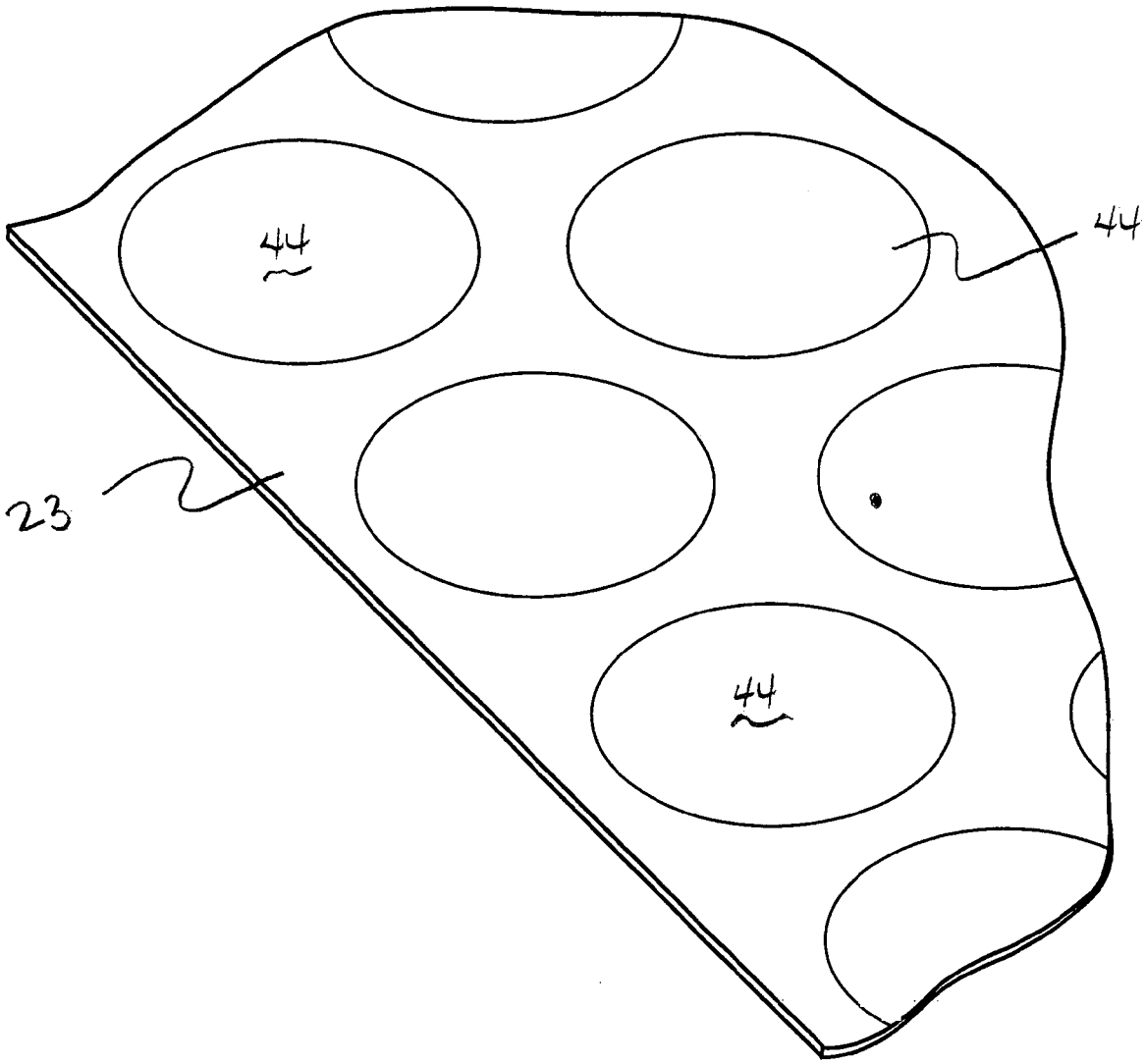
FIG. 4 is a perspective view of a non-woven web, such as a paper web, treated in accordance with the present invention.

Referring to FIG. 4, one exemplary embodiment of a paper product treated in accordance with the present invention is shown. As illustrated, the paper product includes a paper web 23 treated with a composition 44 in the form of discrete shapes, such as circles. As shown, in this embodiment, each droplet is spaced apart from adjacent droplets. In alternative embodiments, however, the droplets can overlap.

The diameter of the discrete shapes located on the paper web 23 can vary depending upon the particular application. For many applications, the diameter of the discrete shapes can be up to about 5 mm. For instance, the discrete shapes can have a diameter of from about 1 mm to about 3 mm when a valve jet printer is used. When using other types of printers, however, the diameter of the discrete shapes can be less than about 200 microns, such as less than 100 microns or less than 50 microns. For example, in one particular embodiment, the discrete shapes can have a diameter of less than about 10 microns.

The amount and location of the discrete shapes formed from the composition can vary depending upon the particular application. Of particular advantage, many non-impact printers allow for controlled deposition of the composition. In general, the composition is applied to the non-woven web so as to cover from about 1% to about 99% of the surface area of one side of the web. For instance, the composition can cover from about 5% to about 60% of the surface area of one side of the web, and more particularly can cover from about 30% to about 60% of the surface area of one side of the web. The amount of surface area that is covered by the composition depends greatly upon the chemical additive being applied. Many additives, for instance, may be applied so as to cover less than about 50% of the surface area of one side of the web, such as less than about 25% of the surface area of one side of the web, such as less than about 20% of the surface area of one side of the web, and, in one embodiment, may cover from about 1% to about 10% of the surface area of one side of the web.

The composition can also be applied such that the density of the discrete areas can be varied and controlled. In general, the density of the discrete areas in any given direction on the web will depend upon the diameter of the areas, the physical properties of the composition and the desired result. The density of the discrete areas in the machine direction, for instance, may vary from about 5 drops per inch to greater than about 1,000 drops per inch. In many embodiments, the density in the machine direction may be from about 5 drops per inch to about 100 drops per inch. However, in various embodiments, the density of the drops may be greater than about 200 drops per inch, 500 drops per inch, 700 drops per inch, and, in one embodiment, greater than about 1,000 drops per inch.

The density of the drops in the cross-machine direction may generally fall within the same ranges as described above for the machine direction. The density in the cross-machine direction, however, may depend upon the number of print heads spaced along the width of the moving substrate.

The add-on rate of the composition can also vary depending upon the particular application. For instance, the add-on rate can be such that the composition is applied to the non-woven web in an amount from about 0.01% to about 10% by weight or greater. In some embodiments, for example, the add-on rate may be greater than about 20%, greater than about 30%, greater than about 40%, and in one embodiment, even greater than about 50%.

In the embodiment illustrated in FIG. 1, the non-impact printer 30 is shown incorporated directly into the paper making process line. Alternatively, however, the non-woven web can be treated with a composition using a non-impact printer on a converting line after formation of the non-woven web. For instance, FIG. 3 illustrates another embodiment of a process for treating a formed web with a composition in accordance with the present invention.

Figure 3:
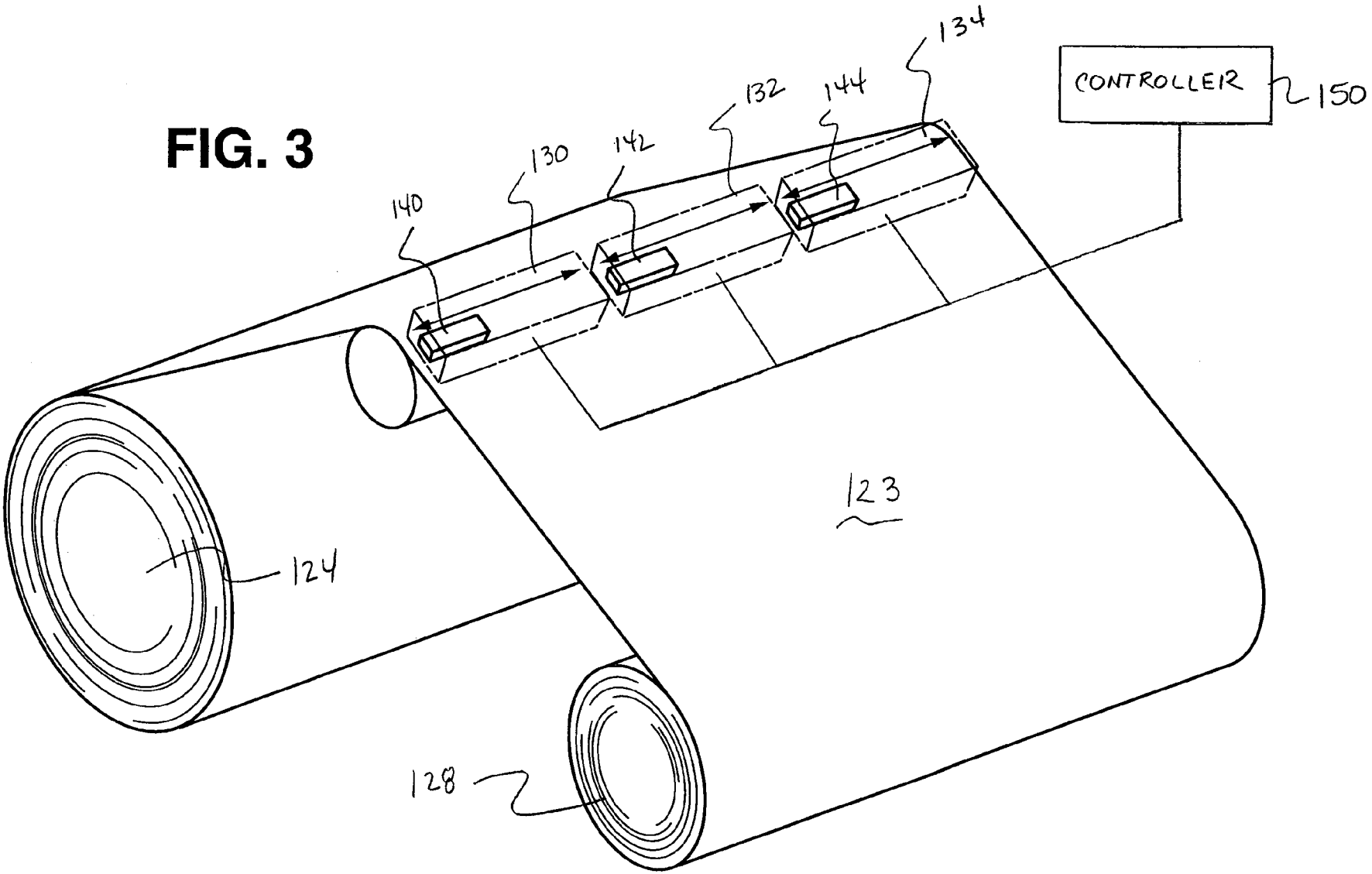
FIG. 3 is a perspective view of one embodiment for applying compositions to non-woven webs in accordance with the present invention.

As shown in FIG. 3, a tissue web 123 is unwound from a supply roll 124 and rewound into a roll 128. During the rewinding operation, the tissue web 123 is treated with a composition using, in this embodiment, three non-impact printers 130, 132 and 134 spaced across the web in the cross-machine direction. As shown, each non-impact printer 130, 132 and 134 includes a respective printing head 140, 142 and 144 that moves across a portion of the tissue web 123 and deposits a composition as discrete droplets. Depending upon the non-impact printer used, a greater or lesser number of printing devices and/or print heads may be used in the present invention.

As described above, the non-impact printers, which can be ink jet printers, are capable of applying a composition to a tissue web in a controlled manner. The composition is applied to the web as discrete droplets that provide the web with treated areas and untreated areas. As shown in FIG. 3, each of the non-impact printers can be placed in communication with a controller 150. The controller 150 can be, for instance, a microprocessor, a computer, or any other suitable programmable logic unit.

In one embodiment, the controller 150 can be configured to store programs that are designed to control the amount of composition applied to the paper web 123. For instance, one or more patterns can be stored in the controller 150. The composition can be applied to the paper web 123 using the non-impact printers 130, 132 and 134 according to the stored pattern.

When using a controller 150 in conjunction with the non-impact printers, various advantages and benefits are realized. For instance, since the non-impact printers can be digitally controlled, designs or patters being printed onto the non-woven webs can be instantaneously adjusted as desired. The non-impact printers in conjunction with a controller can also store a limitless number of designs and can be switched between designs easily and almost instantaneously. Further, designs can be created and used very rapidly. When changing patterns, drop size can be changed, the amount of surface area coverage can be changed, and the add-on rate of the composition can also be varied.

In view of the flexibility provided by the above-described printing system, the present invention further provides the opportunities to make and create unique and novel products. For instance, in one embodiment, the formed paper web 123 can include a pattern that is incorporated into the structure of the web. For example, the web can include a pattern of high density and low density areas and/or a pattern of high basis weight and low basis weight areas. The pattern can be formed into the web using various processes and techniques. For instance, the pattern incorporated into the web can be formed through embossing. Alternatively, a pattern can be formed in the web during through-air drying by using a through-air drying fabric having a three dimensional surface that becomes superimposed on the web as disclosed in, for instance, U.S. Pat. No. 5,129,988 to Farrington. Jr., which is incorporated herein by reference. A densified pattern can also be formed in the web according to the process disclosed in U.S. Pat. No. 5,935,381 to Trokhan, which is also incorporated herein by reference.

Once a pattern is incorporated into the web, the non-impact printer of the present invention can then be used to apply a composition to the web according to a separate and distinct pattern. The pattern by which the composition is applied can match or otherwise be placed in synchronicity with the pattern that was incorporated into the web during its formation. For instance, the formed paper web can be fed into the non-impact printing device and the printed pattern of the composition can be cued to begin at a particular point in the pattern that has been physically incorporated into the web. To maintain a match between the physical pattern and the printed pattern, the treated web can be monitored. As explained above, through the use of a controller, the printed pattern being applied by the non-impact printing device can be adjusted and varied quickly and easily for maintaining the patterns in alignment.

In one particular embodiment, for instance, the tissue web can include a physical pattern of peaks and valleys. The composition of the present invention can be applied to the paper web in a manner such that the composition only is applied to the valley areas or is only applied to the peak areas as desired. Through this process, the composition can be applied to the web at strategic locations for maximizing its use, while also optimizing the water absorbency properties of the web.

The pattern by which the composition is applied can be somewhat random or can be more defined and comprise, for instance, geometric shapes.

Figure 5:
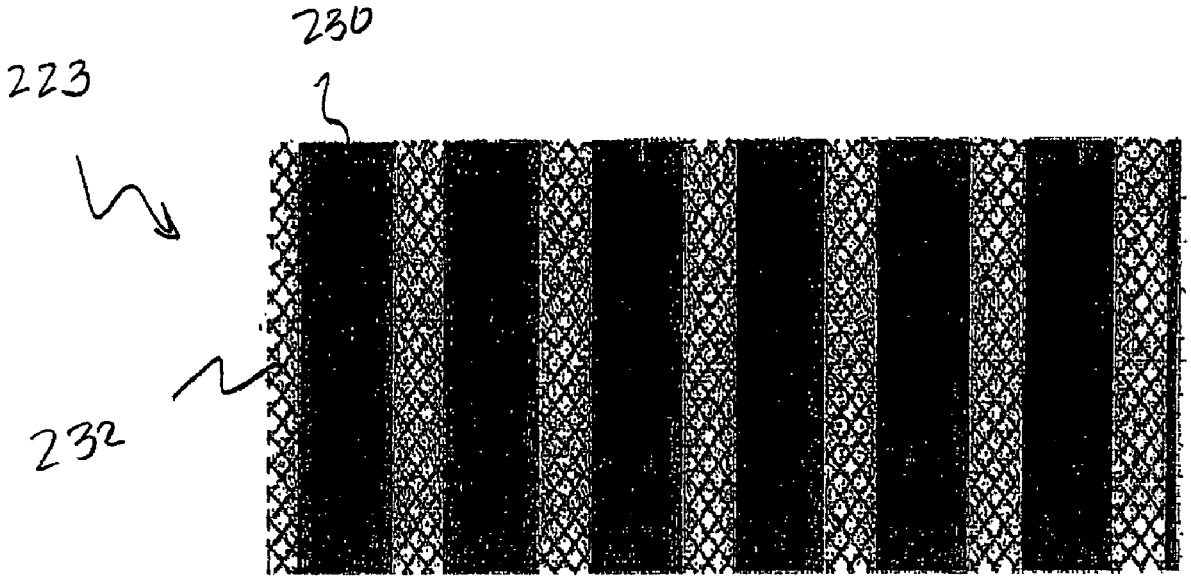
FIG. 5 is a plan view of one embodiment of a base sheet treated in accordance with the present invention.
Figure 6:
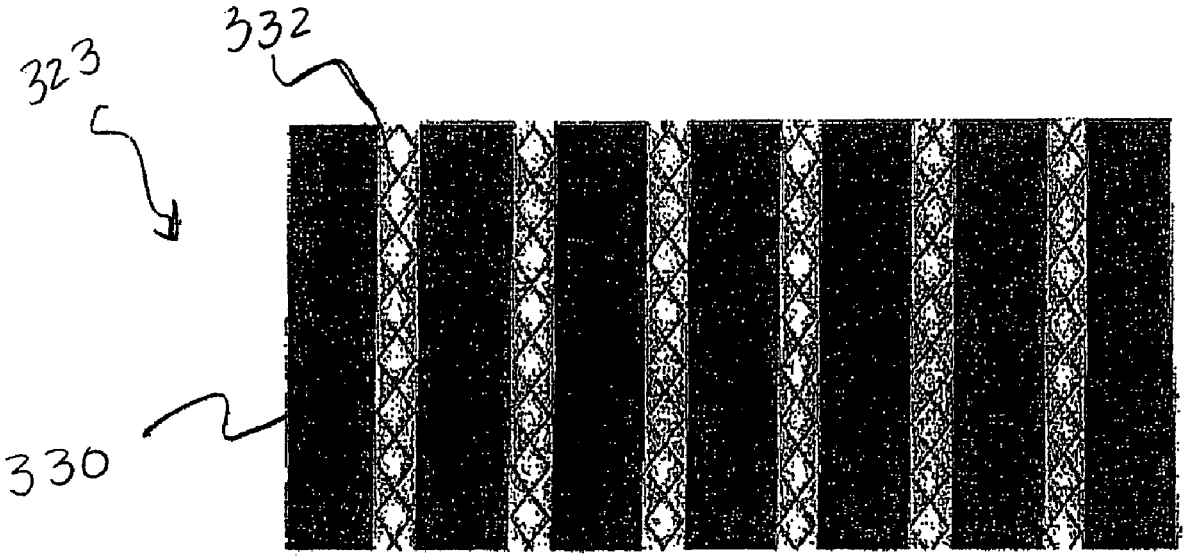
FIG. 6 is a plan view of another embodiment of a base sheet treated in accordance with the present invention.
Figure 7:
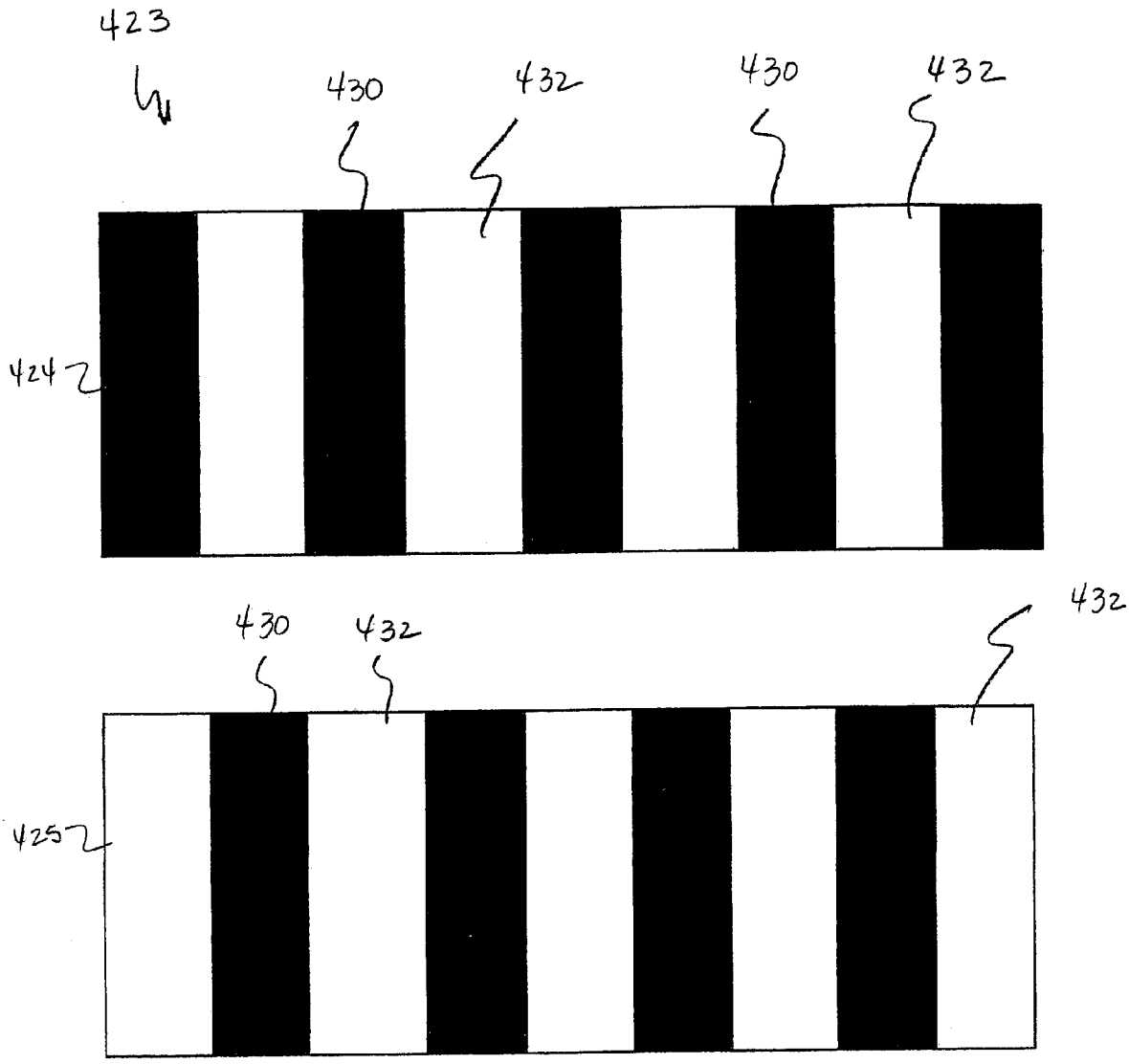
FIG. 7 is a plan view of a first side and an opposite side of a base sheet (one or more plies) treated in accordance with the present invention.

For exemplary purposes only, FIGS. 5-7 show various embodiments of patterns that may be used in applying compositions according to the present invention to, for instance, tissue webs or other non-wovens.

For example, referring to FIG. 5, one embodiment of one side of a base sheet generally 223 treated in accordance with the present invention is shown. Base sheet 223 can be, for instance, any suitable tissue product, such as a facial tissue, bath tissue, paper towel, industrial wiper, wet wipe, and the like. The base sheet 223 can have a single ply or can have a plurality of plies.

In accordance with the present invention, the base sheet 223 is treated with a composition containing a chemical agent, such as, for instance, a softening agent. As shown, the base sheet includes treated areas 230 and untreated areas 232. The treated areas 230 and the untreated areas 232 generally form columns on the sheet. The untreated areas 232, however, further include a pattern of the composition containing the chemical additive. In particular, the composition is applied in the form of a grid in each of the columns in which the untreated areas appear.

When using a non-impact printer in accordance with the present invention, the treated areas can appear as discrete shapes if the image of the sheet 223 is magnified. In other embodiments, however, the composition may be printed onto the base sheet 223 such that a continuous layer forms.

The composition can be applied to a single side of the base sheet 223 or can be applied to both sides of the base sheet.

FIG. 6 also shows a base sheet generally 323 including columns of treated areas 330 and columns of untreated areas 332 that further include a grid where further amounts of the composition have been applied.

Referring to FIG. 7, another embodiment of a base sheet generally 423 treated in accordance with the present invention is shown. In this embodiment, the composition has been applied to a first side of the base sheet 424 and to an opposite side of the base sheet 425. The base sheet 423 includes treated areas 430 and untreated areas 432. In this embodiment, similar to FIGS. 5 and 6, the treated areas 430 and the untreated areas 432 form alternating columns on the base sheet.

In this embodiment, however, the treated areas 430 are in an offset relationship from the first side of the sheet to the second side of the sheet. Specifically, the treated areas on one side of the sheet are in alignment with untreated areas on the opposite side of the sheet and vice versa. In this manner, when applying a hydrophobic additive to the sheet, liquids can be quickly absorbed by the base sheet through the untreated areas 432 and yet remain retained within the base sheet due to opposing treated areas. In particular, the treated areas 430 on each side of the base sheet prevent liquids from flowing through the base sheet.

It should be understood that in addition to columns, various other patterns may be used in applying compositions to non-woven webs in accordance with the present invention. For instance, in other embodiments, discrete aesthetic designs can be applied to the base sheet in accordance with the present invention. For example, the designs can be flowers, logos or any other suitable figure. In order to make the patterns visible to a user, the composition can be combined with a dye or other suitable color-indicating agent.

An additional advantage to a non-impact method of printing is the ability to apply multiple compositions to the web in a manner such that the compositions reside in discrete, non-overlapping regions on the same side of the sheet. Those skilled in the art will recognize the difficulty in achieving such registration with traditional known in the art application methods. Discrete application is especially beneficial when two antagonistic materials are applied to the sheet. For example, it may be beneficial to apply both a strength agent and a topical debonder to the sheet. If applied in overlapping regions, the action of the debonder may cancel the interaction of the strength agent with the result being that no or diminished benefit is realized.

Figure 8:
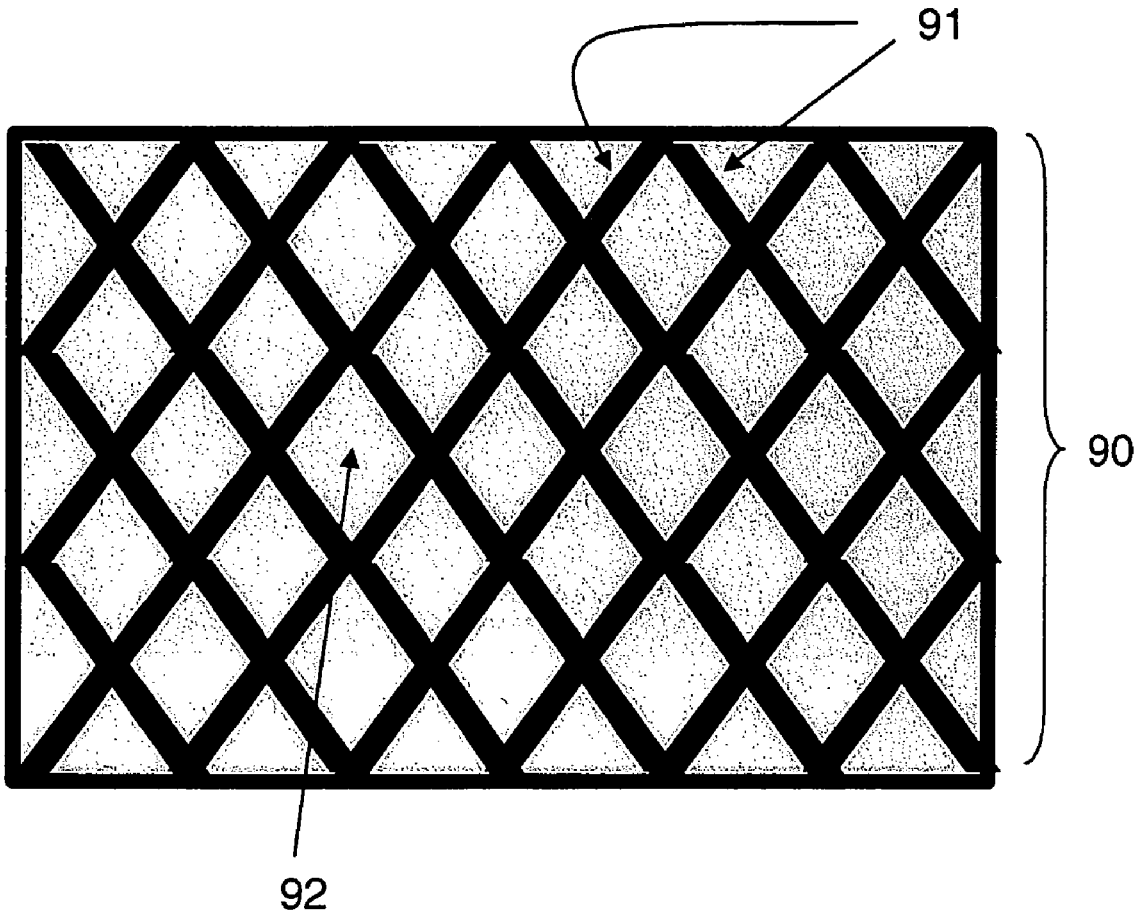
FIG. 8 is a plan view of another embodiment of a base sheet treated in accordance with the present invention.

In a specific embodiment of the present invention one of the compositions is applied in a pattern that is continuous in the x-y directions of the sheet while the second composition is applied to the discontinuous regions of the sheet. For example, FIG. 8 shows a tissue sheet (90) comprising two compositions applied topically to the sheet. The first composition is applied to regions (91) of the tissue sheet (90) in such a manner that the regions (91) form a continuous pattern across the machine and cross directions of the tissue sheet (90). In FIG. 8, the continuous regions are shown by the dark lined regions. At least one second composition is applied to the non-continuous regions (92) of the tissue sheet (90) in such a manner that less than 10% of the area of treated region (91) overlaps with the treated regions (92) of the tissue sheet (90). In FIG. 8, the discontinuous regions (92) are shown by the lightly shaded areas in the figure. In another specific embodiment less than 5% of the area of treated region (91) overlaps with the treated regions (92) and in still another embodiment about 0% of the area of the treated region (91) overlaps with the treated regions (92) of the tissue sheet (90).

As described above, the process of the present invention is particularly well suited to applying hydrophobic compositions to tissue webs without destroying the wettability properties of the web. For instance, since the composition is applied as discrete droplets, compositions can be applied uniformly over an entire surface area of a web while leaving untreated areas in an amount sufficient for the web to absorb liquids. Further, in other embodiments, tissue webs can be produced such as those shown in FIGS. 5-7 due to the amount of control that is maintained when using a non-impact printer. In general, hydrophobic compositions can be applied to webs while the webs still retain hydrophilic properties and are still wettable.

One test that measures the wettability of a web is referred to as the "Wet Out Time" test. The Wet Out Time of paper webs treated in accordance with the present invention can be about 10 seconds or less, and more specifically about 8 seconds or less. For instance, paper webs treated in accordance with the present invention can have a Wet Out Time of about 10 seconds or less, still more specifically about 5 seconds or less, still more specifically from about 4 to about 6 seconds.

As used herein, "Wet Out time" is related to absorbency and is the time it takes for a given sample to completely wet out when placed in water. More specifically, the Wet Out Time is determined by cutting 20 sheets of the tissue sample into 2.5 inch squares. The number of sheets used in the test is independent of the number of plies per sheet of product. The 20 square sheets are stacked together and stapled at each corner to form a pad. The pad is held close to the surface of a constant temperature distilled water bath (23+/−2° C.), which is the appropriate size and depth to ensure the saturated specimen does not contact the bottom of the container and the top surface of the water at the same time, and dropped flat onto the water surface, staple points down. The time taken for the pad to become completely saturated, measured in seconds, is the Wet Out Time for the sample and represents the absorbent rate of the tissue. Increases in the Wet Out Time represent a decrease in the absorbent rate.

In addition to producing paper webs having good wettability characteristics, the process of the present invention has been also found to improve other water retention and absorbency properties of the web. For example, it has been discovered by the present inventors that when using a non-impact printing device in accordance with the present invention, in one embodiment, the composition can be applied so as to remain primarily on the outer surface of the paper web without migrating into the interior. This construction is particularly useful when applying compositions to multiply products. For instance, when applying a composition to a three-ply product, it has been discovered that the composition can be applied such that there is little or no migration of the composition to the middle ply. Consequently, although the water absorption properties of the outer plies may be reduced, the water absorption properties of the inner ply remain substantially unchanged. Ultimately, a paper product can be treated with a hydrophobic composition in accordance with the present invention and can remain water absorbable due to the untreated areas present on the outside surface of the product, remain water absorbable in the middle of the product, and have good liquid retention properties, since the composition applied to the web tends to act as a liquid barrier coating.

For example, the process of the present invention may apply a composition to a substrate, such as a tissue product, such that greater than 50% of the composition remains on the surface of the product. In other embodiments, for instance, greater than 60%, greater than 70%, greater than 80%, and even greater than 90% of the composition remains on the surface of the product. In fact, in one embodiment, it is believed that greater than 95% of the composition may remain at the surface of the product.

As stated above, in addition to softening agents, various other chemical additives may be applied to substrates, such as non-woven webs, in accordance with the present invention.

Optional Chemical Additives

Optional chemical additives may also be added to the aqueous papermaking furnish or to the embryonic tissue sheet to impart additional benefits to the product and process and are not antagonistic to the intended benefits of the present invention. The following materials are included as examples of additional chemicals that may be applied to the tissue sheet via the method of the present invention. The chemicals are included as examples and are not intended to limit the scope of the present invention. Such chemicals may be added at any point in the papermaking process, such as before or after addition of the hydrophobic additive. They may also be added in combination with one another or separate. Alternative these agents may be incorporated separate from the method of the present invention.

Strength Agents

Wet and dry strength agents may also be applied to the tissue sheet. As used herein, "wet strength agents" refer to materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it may be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph, and other body exudates.

Any material that when added to a tissue sheet or sheet results in providing the tissue sheet with a mean wet geometric tensile strength:dry geometric tensile strength ratio in excess of about 0.1 will, for purposes of the present invention, be termed a wet strength agent. Typically these materials are termed either as permanent wet strength agents or as "temporary" wet strength agents. For the purposes of differentiating permanent wet strength agents from temporary wet strength agents, the permanent wet strength agents will be defined as those resins which, when incorporated into paper or tissue products, will provide a paper or tissue product that retains more than 50% of its original wet strength after exposure to water for a period of at least five minutes. Temporary wet strength agents are those which show about 50% or less than, of their original wet strength after being saturated with water for five minutes. Both classes of wet strength agents find application in the present invention. The amount of wet strength agent added to the pulp fibers may be at least about 0.1 dry weight percent, more specifically about 0.2 dry weight percent or greater, and still more specifically from about 0.1 to about 3 dry weight percent, based on the dry weight of the fibers.

Permanent wet strength agents will typically provide a more or less long-term wet resilience to the structure of a tissue sheet. In contrast, the temporary wet strength agents will typically provide tissue sheet structures that had low density and high resilience, but would not provide a structure that had long-term resistance to exposure to water or body fluids.

Wet and Temporary Wet Strength Agents

The temporary wet strength agents may be cationic, nonionic or anionic. Such compounds include PAREZ™ 631 NC and PAREZ® 725 temporary wet strength resins that are cationic glyoxylated polyacrylamide available from Cytec Industries (West Paterson, N.J.). This and similar resins are described in U.S. Pat. No. 3,556,932, issued on Jan. 19, 1971 to Coscia et al. and U.S. Pat. No. 3,556,933, issued on Jan. 19, 1971 to Williams et al. Hercobond 1366, manufactured by Hercules, Inc., located at Wilmington, Del., is another commercially available cationic glyoxylated polyacrylamide that may be used in accordance with the present invention. Additional examples of temporary wet strength agents include dialdehyde starches such as Cobond® 1000 from National Starch and Chemcial Company and other aldehyde containing polymers such as those described in U.S. Pat. No. 6,224,714 issued on May 1, 2001 to Schroeder et al.; U.S. Pat. No. 6,274,667 issued on Aug. 14, 2001 to Shannon et al.; U.S. Pat. No. 6,287,418 issued on Sep. 11, 2001 to Schroeder et al.; and, U.S. Pat. No. 6,365,667 issued on Apr. 2, 2002 to Shannon et al., the disclosures of which are herein incorporated by reference to the extend they are non-contradictory herewith.

Permanent wet strength agents comprising cationic oligomeric or polymeric resins can be used in the present invention. Polyamide-polyamine-epichlorohydrin type resins such as KYMENE 557H sold by Hercules, Inc., located at Wilmington, Del., are the most widely used permanent wet-strength agents and are suitable for use in the present invention. Such materials have been described in the following U.S. Pat. No. 3,700,623 issued on Oct. 24, 1972 to Keim; U.S. Pat. No. 3,772,076 issued on Nov. 13, 1973 to Keim; U.S. Pat. No. 3,855,158 issued on Dec. 17, 1974 to Petrovich et al.; U.S. Pat. No. 3,899,388 issued on Aug. 12, 1975 to Petrovich et al.; U.S. Pat. No. 4,129,528 issued on Dec. 12, 1978 to Petrovich et al.; U.S. Pat. No. 4,147,586 issued on Apr. 3, 1979 to Petrovich et al.; and, U.S. Pat. No. 4,222,921 issued on Sep. 16, 1980 to van Eenam. Other cationic resins include polyethylenimine resins and aminoplast resins obtained by reaction of formaldehyde with melamine or urea. It is often advantageous to use both permanent and temporary wet strength resins in the manufacture of tissue products with such use being recognized as falling within the scope of the present invention.

Dry Strength Agents

Dry strength agents may also be applied to the tissue sheet without affecting the performance of the disclosed cationic synthetic co-polymers of the present invention. Such materials used as dry strength agents are well known in the art and include but are not limited to modified starches and other polysaccharides such as cationic, amphoteric, and anionic starches and guar and locust bean gums, modified polyacrylamides, carboxymethylcellulose, sugars, polyvinyl alcohol, chitosans, and the like. Such dry strength agents are typically added to a fiber slurry prior to tissue sheet formation or as part of the creping package. It may at times, however, be beneficial to blend the dry strength agent with the cationic synthetic co-polymers of the present invention and apply the two chemicals simultaneously to the tissue sheet.

Additional Softening Agents

At times it may be advantageous to add additional debonders or softening chemistries to a tissue sheet. Examples of such debonders and softening chemistries are broadly taught in the art. Exemplary compounds include the simple quaternary ammonium salts having the general formula $(R^{1'})_{4-b}$—$N^+$—$(R^{1''})_b$ $X^-$ wherein R1' is a C1-6 alkyl group, R1" is a C14-C22 alkyl group, b is an integer from 1 to 3 and X— is any suitable counterion. Other similar compounds include the monoester, diester, monoamide and diamide derivatives of the simple quaternary ammonium salts. A number of variations on these quaternary ammonium compounds are known and should be considered to fall within the scope of the present invention. Additional softening compositions include cationic oleyl imidazoline materials such as methyl-1-oleyl amidoethyl-2-oleyl imidazolinium methylsulfate commercially available as Mackernium DC-183 from Mcintyre Ltd., located in University Park, Ill. and Prosoft TQ-1003 available from Hercules, Inc.

Chemicals Not Added Via Method

As mentioned previously most chemicals can be added either via the method of the present invention or separate from the method of the present invention. There are some chemical agents not suited to application via the current method but which may be contained in the tissue sheet. Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers typically of molecular weight of about 500,000 or less. Drainage and retention aids may also be added to the furnish to improve formation, drainage and fines retention. Included within the retention and drainage aids are microparticle systems containing high surface area, high anionic charge density materials.

Additional examples of additives typically not added by the present invention are those used to treat the process water, solid particulates that are insoluble in water and those additives intended to treat the bulk of the tissue and not just the surface of the tissue. These additives, however, can be present in the products made with the method of the present invention. Examples of such materials and chemicals include, but are not limited to, odor control agents, such as odor absorbents, activated carbon fibers and particles, baby powder, baking soda, chelating agents, zeolites, perfumes or other odor-masking agents, cyclodextrin compounds, other particulate materials and the like. Superabsorbent particles, synthetic fibers, or films may also be employed.

Also included in this list are aesthetic chemicals whose purpose is to supply a visual rather than a physical benefit to the products of the present invention. Examples of such materials include cationic dyes, optical brighteners and the like.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

The invention claimed is:

1. A tissue product comprising:

a base sheet comprising pulp fibers, the base sheet including a first side and a second and opposite side, a topical composition applied to at least one side of the base sheet, the composition comprising a chemical additive, the chemical additive comprising an anti-acne additive, an anti-microbial additive, an anti-fungal additive, an antiseptic additive, an antioxidant, a cosmetic astringent, a drug astringent, a deodorant, an external analgesics, a fragrance, a humectant, a moisturizing agent, an opacifier, a skin conditioning agent, a skin exfoliating agent, a skin protectant, a sunscreen, a strength agent, a debonder, a softener, or mixtures thereof, the composition being non-impact printed on the sheet in the form of discrete droplets, the droplets having a diameter of less than about 3 millimeters, at least 75% of the composition by weight being located at substantially the surface of the sheet, the discrete droplets forming a repetitive pattern on the surface of the sheet.

2. A tissue product as defined in claim 1, wherein the droplets have a diameter of less than about 200 microns.

3. A tissue product as defined in claim 1, wherein the droplets have a diameter of less than about 100 microns.

4. A tissue product as defined in claim 1, wherein the composition is substantially present on the surface in an amount greater than about 90% by weight.

5. A tissue product as defined in claim 1, wherein the droplets are present on the base sheet in a machine direction at a density of from about 5 droplets per inch to about 100 droplets per inch.

6. A tissue product as defined in claim 5, wherein the droplets are present on the base sheet in a cross-machine direction also at a density of from about 5 droplets per inch to about 100 droplets per inch.

7. A tissue product as defined in claim 1, wherein the droplets are present on the base sheet in a machine direction at a density of at least 100 droplets per inch.

8. A tissue product as defined in claim 1, wherein the topical composition is applied to the base sheet at an add-on rate of from about 0.001% to about 10% by weight.

9. A tissue product as defined in claim 1, wherein the tissue product has a bulk of greater than about 2 cc/g.

10. A tissue product as defined in claim 1, wherein the topical composition is applied to the base sheet according to a discernible and repetitive pattern.

11. A tissue product as defined in claim 10, wherein the pattern comprises a plurality of columns.

12. A tissue product as defined in claim 1, wherein the topical composition covers at least 50% of the surface area of the side of the sheet.

13. A tissue product as defined in claim 1, wherein the topical composition covers at least 90% of the surface area of the side of the sheet.

14. A tissue product as defined in claim 1, wherein the chemical additive comprises a polysiloxane.

15. A tissue product as defined in claim 14, wherein the polysiloxane is contained in an emulsion.

16. A tissue product as defined in claim 14, wherein the polysiloxane is hydrophobic.

17. A tissue product as defined in claim 14, wherein the polysiloxane is hydrophilic.

18. A tissue product comprising:

a base sheet comprising pulp fibers, the base sheet including a first side and a second and opposite side, two or more distinct topical compositions non-impact printed onto at least one side of the base sheet, the compositions comprising chemical additives, at least one of the chemical additives comprising an anti-acne additive, an anti-microbial additive, an anti-fungal additive, an antiseptic additive, an antioxidant, a cosmetic astringent, a drug astringent, a deodorant, an external analgesics, a fragrance, a humectant, a moisturizing agent, an opacifier, a skin conditioning agent, a skin exfoliating agent, a skin protectant, a sunscreen, a strength agent, a debonder, a softener, or mixtures thereof, the compositions being applied to the sheet in the form of discrete droplets, the droplets having a diameter of less than about 3 millimeters and wherein the compositions are located in discrete substantially non-overlapping regions of the sheet and wherein the compositions are also located on the sheet according to repetitive patterns.

19. A tissue product as defined in claim 18, wherein the droplets have a diameter of less than about 200 microns.

20. A tissue product as defined in claim 18, wherein the droplets have a diameter of less than about 100 microns.

21. A tissue product as defined in claim 18, wherein at least one of the compositions is substantially present on the surface in an amount greater than about 75% by weight.

22. A tissue product as defined in claim 18, wherein the droplets are present on the base sheet in a machine direction at a density of from about 5 droplets per inch to about 100 droplets per inch.

23. A tissue product as defined in claim 18, wherein the droplets are present on the base sheet in a machine direction at a density of at least 100 droplets per inch.

24. A tissue product as defined in claim 18, wherein the topical compositions are applied to the base sheet at an add-on rate of from about 0.001% to about 10% by weight.

25. A tissue product as defined in claim 18, wherein the tissue product has a bulk of greater than about 2 cc/g.

26. A tissue product as defined in claim 18, wherein each of the topical compositions is applied to the base sheet according to a repetitive pattern.

27. A tissue product as defined in claim 26, wherein each of the patterns comprises a plurality of columns.

28. A tissue product as defined in claim 26, wherein at least one of the compositions is present in as a continuous pattern across the machine and cross directions of the sheet and wherein at least one of the other compositions is present in a discontinuous pattern across the machine and cross directions of the sheet.

29. The tissue product as defined in claim 28, wherein less than 10% of the area of continuously treated region overlaps with the discontinuously treated regions of the tissue sheet.

30. The tissue product as defined in claim 28, wherein less than 5% of the area of continuously treated region overlaps with the discontinuously treated regions of the tissue sheet.

31. The tissue product as defined in claim 28, wherein about 0% of the area of continuously treated region overlaps with the discontinuously treated regions of the tissue sheet.

32. A tissue product as defined in claim 18, wherein the topical compositions cover at least 50% of the surface area of the side of the sheet.

33. A tissue product as defined in claim 18, wherein the topical compositions cover at least 70% of the surface area of the side of the sheet.

34. A tissue product as defined in claim 18, wherein at least one of the chemical additives comprises a polysiloxane.

35. A tissue product as defined in claim 34, wherein the polysiloxane is hydrophobic.

36. A tissue product as defined in claim 34, wherein the polysiloxane is hydrophilic.

* * * * *